United States Patent [19]

Burke, Jr. et al.

[11] 4,077,214

[45] Mar. 7, 1978

[54] CONDENSING VAPOR HEAT ENGINE WITH CONSTANT VOLUME SUPERHEATING AND EVAPORATING

[76] Inventors: Jerry Allen Burke, Jr.; John Gordon Davoud, both of 2541 Stratford Rd., Richmond, Va. 23225

[21] Appl. No.: 714,501

[22] Filed: Aug. 16, 1976

[51] Int. Cl.[2] ..... F01K 21/02

[52] U.S. Cl. ..... 60/512; 60/514; 60/653

[58] Field of Search ..... 60/508–515, 60/653

[56] References Cited

U.S. PATENT DOCUMENTS

| | | | |
|---|---|---|---|
| 2,839,888 | 6/1958 | Mallory | 60/514 |
| 2,867,975 | 1/1959 | Mallory | 60/514 |
| 3,835,650 | 9/1974 | Chesmejef | 60/670 X |
| 3,905,195 | 9/1975 | Gregory | 60/512 |
| 3,990,238 | 11/1976 | Bailey | 60/513 |

OTHER PUBLICATIONS

Power, vol. 97, Sept. 1953, pp. 80 and 81 "Superpressures" by B. G. Skrotzki.

*Primary Examiner*—Allen M. Ostrager
*Attorney, Agent, or Firm*—Harold L. Stowell

[57] ABSTRACT

A heat-power engine and system using a condensable vapor as the working fluid has a cylinder with a piston operating therein characterized in that the heat input communicates with the clearance volume of the cylinder, and all of the working fluid, mechanically and thermodynamically possible, is removed from the cylinder adjacent and/or following bottom dead center of the piston.

14 Claims, 3 Drawing Figures

CONDENSING VAPOR HEAT ENGINE WITH CONSTANT VOLUME SUPERHEATING AND EVAPORATING

CROSS-REFERENCES TO RELATED PATENTS

Related subject matter is disclosed and claimed in related U.S. Pat. Nos.: 3,716,990 to J. G. Davoud; 3,772,883 to J. G. Davoud and J. A. Burke, Jr.; 3,798,908 to J. G. Davoud and J. A. Burke, Jr.; and Application Ser. No. 714,513 filed even date herewith entitled "Condensing Vapor Heat Engine with Two-Phase Compression and Constant Volume Heating" to J. G. Davoud and J. A. Burke, Jr.

BACKGROUND OF THE INVENTION

Reciprocating engines using a condensable vapor, usually steam, and with or without condensers, have been known and widely used for about two hundred years. For most of this period, a low inherent thermal efficiency was the price paid for relatively mild steam conditions, that is, low temperature and low pressure.

These mild steam conditions were for a long period dictated by the boiler for the condensable vapor. The fire tube boiler was simple, sturdy, and easy to operate and it is still in wide use. Even today, however, a fire tube boiler is limited to maximum pressures of about 250 psig. and much lower pressures are often used. The fire tube boiler can be used with a superheater, but the majority of reciprocating steam engines in use, until the virtual eclipse of the genre in the twentieth century, made use of saturated steam at pressures below 250 psig. These steam conditions allowed the use of simple inlet valves, reasonably effective under the conditions used, having a variety of designs such as slide valves, piston valves, and poppet valves, and a simple lubrication system.

A further feature of this prior art type of steam engine which also bought simplicity at the expense of efficiency, was a relatively small expansion ratio of steam and, in many cases, none at all. This simplified valve design and allowed easy inlet valve intervals.

The net result was an engine which was simple, sturdy, long lived, and required no exotic or unusual construction materials or techniques; however, the price paid was low efficiency.

In recent years, a considerable effort has been made to develop condensing steam reciprocating engines with much higher efficiencies. A natural approach, with predictable theoretical results, but still within the confines of the Rankine condensing cycle, has been to use much higher temperatures, pressures, and expansion ratios. Steam conditions at inlet of 1,000° F with pressures from 1,000 to 3,000 psia, and pressure ratios in expansion of 25 to 1, have been employed. New techniques and improved materials have been used and great progress has been made in rapid and efficient steam generation through the use of improved monotube type boiler-superheaters.

Another approach to obtain higher efficiency has been to alter the basic Rankine cycle. U.S. Pat. Nos. 3,798,908; 3,716,990 and 3,772,883 teach a condensing vapor cycle in which maximum operating pressure is attained by mechanical compression of wet vapor, i.e., two phase compression. This cycle shows significantly higher ideal efficiency than the Rankine cycle with identical vapor conditions at inlet and exhaust. This improved cycle has relatively high temperature as a basic requirement in order to show worth-while improvement over the Rankine cycle.

All these improved engine types, requiring high inlet temperatures and pressures, and very short inlet valve intervals, make heavy demands on both mechanical features and metallurgy. As expected, they show predictably higher efficiency than condensing engines operating with saturated steam at lower pressures. Very recent developments in steam engines for automotive use now show that even these improved efficiencies may be insufficient for modern vehicular use. Further projections based on still higher temperatures, pressures, and expansion ratios are now under consideration. Inlet temperatures of 1,500° F and pressures of 3000 psig are predicted with overall pressure ratios of 80 in the expansion process, requiring a compound engine with reheat. These conditions will require new frontiers in inlet valve material and mechanical design.

The net result is that the provision of suitable inlet valving sets one constraint on the reciprocating condensing vapor engine based on either the Rankine or the steam compression cycles. Another constraint is set by the requirement of upper cylinder lubrication. Rankine engines operating at steam inlet temperatures of 1000° F have been shown to be capable of prolonged operation with monotube boilers using hydrocarbon-based oils for upper cylinder lubrication but it is extremely unlikely that this method will suffice at 1500° F, much less at even higher temperatures.

A third constraint is economic—the high cost in strategic materials such as nickel and chromium required in monotube boiler-superheaters and reheaters operating at such elevated temperatures and pressures.

A way to obviate these problems is through the use of a condensing vapor engine using a modification of the Stirling cycle. This method is disclosed and claimed in U.S. Patent application 596,165 filed July 15, 1975 now Pat. No. 3,996,745. This cycle makes use of the cooling effect of two-phase vapor compression as taught in U.S. Pat. Nos. 3,798,908; 3,772,889 and 3,772,883. Lubrication and piston sealing in the engine are similar to methods developed for high pressure Stirling engines using gaseous working fluids such as hydrogen and helium. In engines of this type, the piston is sealed by plastic rings at the bottom of a long cylinder, so designed that the ring always operates in a relatively cool portion of the cylinder, while the hot space of the cylinder and the top of the piston can be at very high temperatures in excess of 1500° F. Such engines, of the so-called Rinia type, with interconnected hot and cold spaces, have no inlet valves at all; require no lubricants and in both the gaseous and condensing vapor type are mechanically simple as regards valve requirements.

The gaseous Stirling engine has neither inlet nor outlet valves in the normal mode of operation; while the condensing vapor type has an outlet valve for passing part of the condensable vapor to the condenser, and an injector for injecting condensate into the so-called cool space during compression. These are easy operations both as regards mechanical features and metallurgical requirements.

A negative feature of the Stirling cycle is the need to cycle the working substance in the gaseous state between hot and cold spaces in the engine. The combined effect of gaseous viscosity and inertia is to reduce the efficiency of the cycle when it is operating at maximum power, i.e., at maximum pressure, as the usual way to alter power output in such engines is to alter the pressure of the working substance.

A further practical problem in the Stirling engine, whether based on gaseous or condensable vapor working substance is design and fabrication of the heater elements between the hot and cold spaces of the engine. To date, no satisfactory compromise has been effected between material cost, engine efficiency, and the requirements of mass production.

Present practice is to use a tube bundle. The material of construction is generally high temperature alloy steel. Metallurgical requirements place a constraint on temperature, and the shape and configuration of the tubes places a further constraint on mass production methods.

Ceramics and cermets, however satisfactory of continuous high temperature operation in an oxidizing flame, pose difficult problems of fabrication.

SUMMARY OF THE INVENTION

The present invention may be defined as a heatpower engine and system using a condensable vapor as the working fluid having a cylinder with a piston operating therein characterized in that the heat input communicates with the clearance volume of the cylinder, and all of the working fluid, mechanically and thermodynamically possible, is removed from the cylinder adjacent and/or following bottom dead center of the piston.

It is a primary object of the present invention to provide a condensing vapor engine which greatly reduces or eliminates altogether the problems described above which are peculiar to external combustion engines of the Rankine and Stirling types.

The overall result is a condensable vapor engine of notable mechanical simplicity, capable of operating at the extremely high temperature necessary to achieve high thermodynamic efficiency and thereby providing a new engine attractive against such good performers as the diesel engine.

DESCRIPTION OF THE PREFERRED EMBODIMENTS

Figure 1:
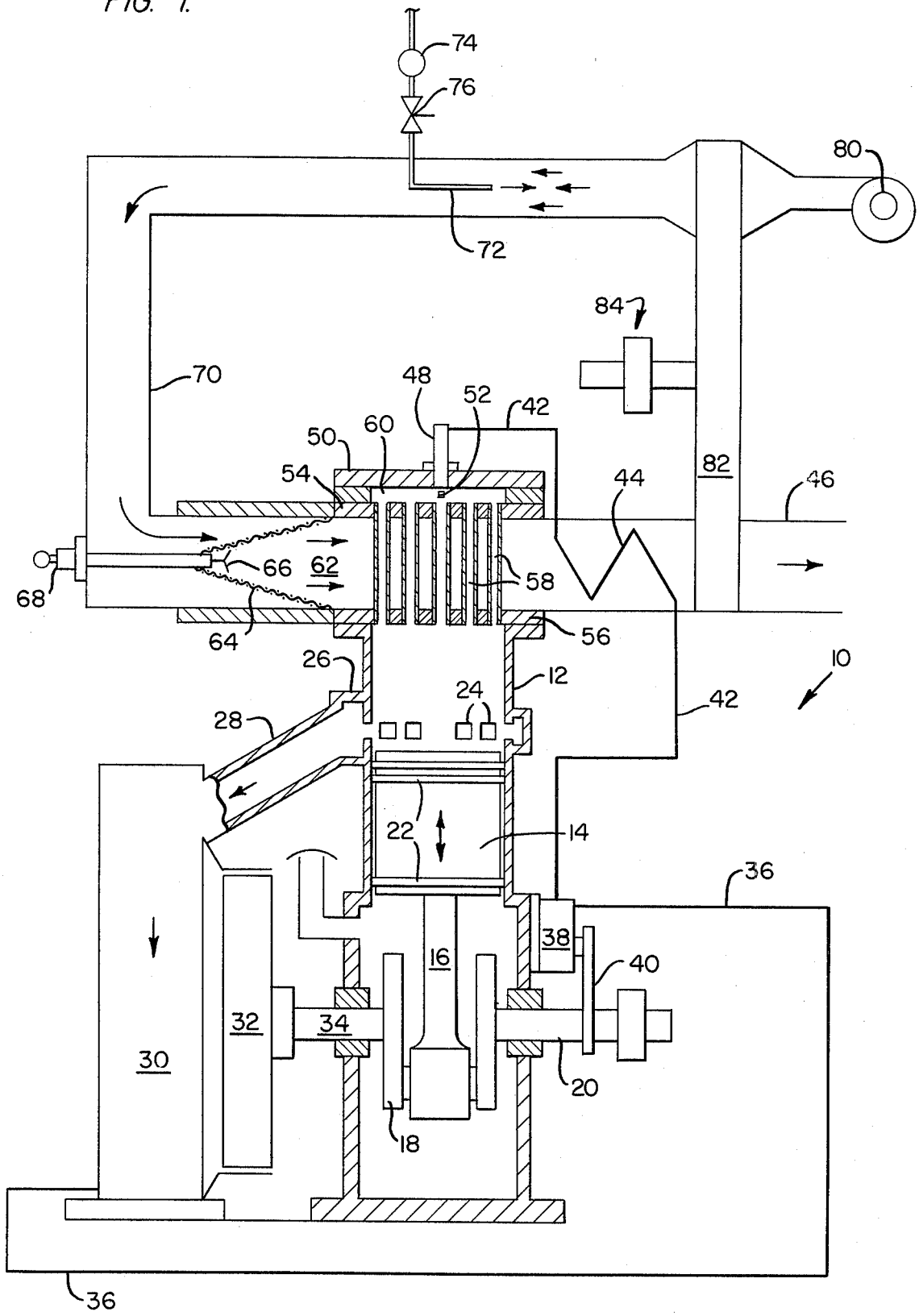
FIG. 1 is a fragmentary, diagrammatic, partial sectional view of an engine embodying the principles of the present invention.

Referring to FIG. 1 of the drawing, 10 generally designates an engine constructed in accordance with the teachings of the present invention. The engine 10 includes a cylinder 12 having reciprocally mounted therein a piston 14. The piston is connected to a pistion rod 16 which in turn is connected to a crank 18. The crank 18 forms a portion of the crank shaft 20.

The piston 14 is suitably ringed as at 22.

In the cylindrical wall of the cylinder 12 are a plurality of exhaust ports 24 which ports communicate with an exhaust steam collection conduit 26 which in turn communicate with an exhaust steam conduit 28 which communicates with a condenser 30. In the illustrated form of the invention, the condenser 30 is air cooled via a combination flywheel and fan 32 driven by output shaft 34 of the engine. As will be more fully described hereinafter, the efficiency of the engine is directly related to the efficiency and temperature of the condenser 30 and preferably the condenser 30 would be operated at a negative pressure and water cooled. Condensate from the condenser 30 is directed via line or pipe 36 to the inlet of water pump 38. The water pump 38 is driven by output shaft 20 via drive means 40 which may be a belt, chain or gears as desired. The high pressure water line 42 from the pump 38 communicates with a feedwater heater 44 in exhaust duct 46 and from the feedwater heater 44 the heated and pressurized liquid is directed to a water injector 48 in the cylinder head 50. Below the injector 48 is an anvil member 52.

Between the cylinder head 50 and the active part of the cylinder 12 are an upper tube plate 54 and a lower tube plate 56, which tube plates mount a plurality of heater tubes 58 which open into the water injection volume 60 at the upper end and into the active portion of the cylinder 12 at the lower end. The main body of the tubes 58 are in communication with a combustion chamber 62, the exhaust end of which comprises exhaust duct 46 and the opposite end is in communication with a flame holder 64 and igniter 66 of spark plug 68.

The combustion zone 62 is provided with combustion air and fuel via duct 70 having mounted therein a fuel injector 72 fed from a source not shown via fuel pump 74 and fuel supply valve 76. The combustion air is provided by an auxiliary compressor or fan 80 which withdraws heat from exhaust duct 46 following the feedwater heater 44. The rotary exchanger 82 is provided with drive means generally designated 84.

Figure 2:
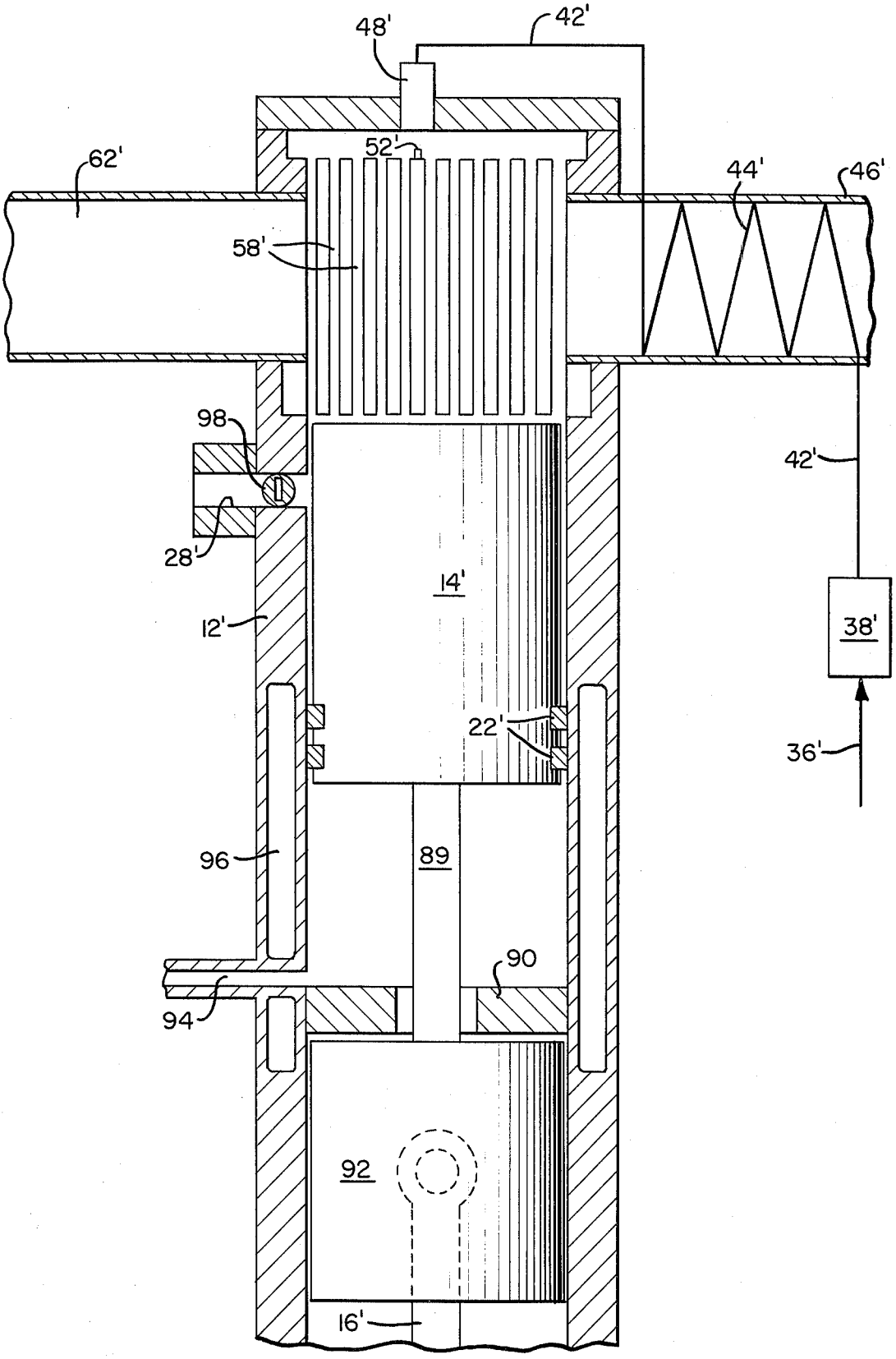
FIG. 2 is a diagrammatic fragmentary partial sectional view through a modified form of engine.

Referring now to FIG. 2 which shows a modified form of engine embodying the principles of the present invention and wherein like parts are provided with primed reference characters and elements not included in FIG. 1 are provided with separate reference characters, the engine 10' includes a cylinder 12' having mounted therein a long piston 14'. The rod 89 of the piston passes through a gland 90 and has associated therewith a crosshead 92. The crosshead 92 is connected to the piston rod 16' which in turn is connected to the crank of the drive shaft (not shown). The lower portion of the cylinder 12' is provided with cooling water space 96 and the space between the lower end of the piston 14' and the crosshead 92 is provided with a vent 94. Adjacent the upper end of the cylinder but below the lower ends of heater tubes 58' is a mechanically operated exhaust valve 98 which permits exhaust steam to pass from the cylinder space into the exhaust collection conduit 28'. The exhaust steam from the conduit 28' flows to a condenser as illustrated in FIG. 1. The condensed liquid is directed via low pressure pipe 36' to feedwater pump 38' and the high pressure water from the pump is directed via conduit 42' to heat exchanger 44' thence to injector 48'. The heat exchanger 44' is mounted in the heater exhaust duct 46' as in the prior form of the invention. A plurality of heater tubes 58' open at both ends are mounted at the upper end of the cylinder with a portion of the walls of the tubes in communication with the combustion zone 62' which combustion zone is fed fuel and compressed air as in the prior form of the invention illustrated in FIG. 1.

METHOD OF OPERATION

When at rest, the piston 14 may have stopped anywhere on the up-stroke or down-stroke or at bottom dead center as shown. To start the engine an auxiliary water pump (either mechanical or hand operated — not shown) would fill line 42, feedwater heater 44 and injector 48 with water to the pressures set in the relief valve in feedwater pump 38. At the same time, the auxiliary motor for the combustor fan 80 (not shown) would supply combustion air. The auxiliary fuel pump drive (not shown) would drive fuel pump 74 to inject fuel through nozzle 72 counter current to the combustion air flowing in duct 70. While passing along duct 70 the fuel evaporates in the air and forms a combustible mixture. On passing through the perferated burner cone 64, which acts as the flame holder, it is initially ignited by spark plug 68 after which the oncoming combustible mixture is ignited by the established flame front of the combustor 62. The heated gas passes about tubes 58 and feedwater heater 44. When the water temperature is up to the desired level in heater 44 and the empty tubes 58 are hot, the starter motor (not shown) is engaged to rotate the engine.

Upon the piston nearing the top of the stroke, water injector 48 is activated to inject a quantity of saturated water held in the injector and feedwater heater at a selected temperature and corresponding pressure. Upon injection into the relatively empty clearance volume which consists of chamber 60 plus the combined volume of tubes 58 and that portion of the swept volume of cylinder 12 unoccupied by the piston, the pressure of the water is reduced by its position in a larger volume. The thus supersaturated water or superheated water is out of equilibrium. A portion of the water flashes into saturated steam to re-establish equilibrium. The proportion of steam and saturated water that results depends on the initial conditions, i.e., the position on the saturated water line as $C_1$ and $C_2$ on FIG. 3 and the conditions in the clearance volume. The pressure drop upon injection is shown on FIG. 3 in one instance $C_1$ down to $D_1$, in another from $C_2$ down to $D_2$. Whether the pressure drop from $C_1$ ever reached $D_1$ depends on the amount of water injected compared to the volume and/or whether steam is already in the colume. Immediately upon injection, the hot tubes 58 and cylinder heads would start exchanging heat to the water and/or the steam. Any water present is evaporated into steam. The total steam would become superheated with an increase in pressure and heat content. This sequence would occur during the period that the crank 18 was passing across the top of the arc so that the piston is substantially still at top dead center; i.e., the 20° before and the 20° after top dead center.

Figure 3:
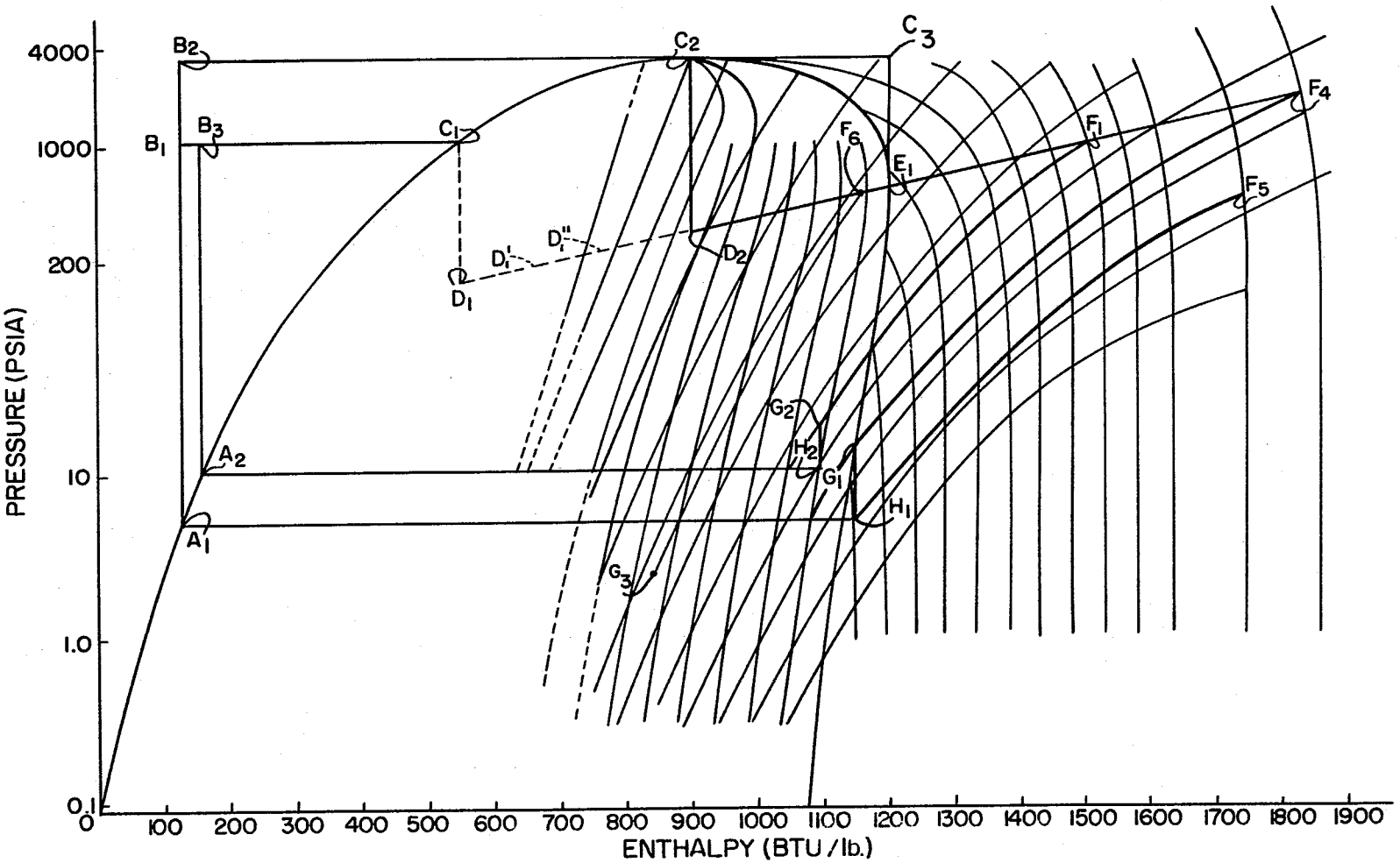
FiG. 3 is a pressure vs enthalpy diagram on which the state points of a family of possible operating conditions are shown. It is pointed out that constant volume heat input increases the pressure and the enthalpy. Consequently, on these coordinates, the heat input line for boiling and superheat is shown with an upward slope with increasing enthalpy.

The steam upon reaching a high temperature and pressure as represented by $E_1$, $F_1$, or $F_4$ of FIG. 3 pushes piston 14 down on the power stroke. The piston acting through connecting rod 16 and crank 18 produces rotary mechanical power at shafts 20 and 34.

As the piston descends and uncovers ports 24 in the wall of cylinder 12, the spent steam flows out into passage 26 which collects the steam from the plurality of ports and conducts the steam through duct 28 to the steam condenser 30 wherein the steam is condensed to water.

By action of pump 38, condensate is drawn from the condenser 30 through line 36 and transferred to line 42 at the design pressure. The function of the feed pump 38 is to supply water to the feedwater heater 44 and to injector 48 in the quantities and at the pressure desired. Water pumped in excess of that required would be sent back to the pump inlet by a relief valve and passages (not shown). Where the design pressure is high, the power to pump the excess water to 700 psi or 3500 psi would be excessive so one of several methods to modulate the pump flow to match the requirement would be used. A variable stroke pump as taught in U.S. Pat. No. 3,951,574 would be suitable.

After the steam is exhausted, the pressures of the condenser prevails in the engine cylinder swept volume plus the clearance volume.

On the up-stroke of the piston, this low pressure, low temperature steam is compressed into the clearance volume. The amount of temperature and pressure occurring in the residual steam depends on the initial conditions in the cylinder at the start of compression and the ratio of the swept volume to the clearance volume. The clearance volume in this engine is composed of volume 60 plus the combined volume of the tube bores plus the space between the piston 14 and head 56 when the piston is at top dead center.

Injecting hot water instead of steam reduces the work necessary to operate the engine valves.

Once the piston has been pushed down by the expanding steam, some of the work is stored in the flywheel 32 and some is available at shaft 20 for doing mechanical work.

Energy in the flywheel is used to move the piston on the up-stroke and to overcome the load on shaft 20 and any negative work of opening the valves and compressing the residual steam that may be in the cylinder volume. Once the piston approaches top dead center, the water injection valve opens and the cycle repeats itself.

The operation of the form of the invention shown in FIG. 2 is like that described with reference to FIG. 1 except that exhaust valve 98 requires timed mechanical connection to the reciprocation of the piston 14'.

From the foregoing, it will be appreciated that the temperature of the combustion gas leaving the tube banks will be high; for example, on the order of 1000° F. This heat has to be conserved and most of the heat is transferred to the water in the feedwater heaters 44 and 44'. The remaining excess heat in the exhaust ducts are imparted by the rotary heat exchangers 82 to the incoming combustion air. The temperature leaving exhaust ducts can thus be reduced to the minimum which is considered to be the dew point of the water vapor in the exhaust gas.

Another substantial feature of this invention is the injection of water instead of steam into the operating cylinders. The orifice for the water passage might be 0.050 inches in diameter compared to a 0.75 inch diameter steam valve orifice to operate in the same engine. Also, the valve stem for the 0.050 inch orifice would be 0.075 inch diameter with a pointed end which would be inserted into the orifice to stop the flow and pulled out of the orifice to allow flow. It would require 440 lbs. of force to open the steam valve and 2 lbs. of force to open the water valve when both were operating under 1000 psi inlet pressure. The actual overall difference is even more because the steam valve is so much bigger and, therefore, weighs more, and thus has a large inertia load. The difference in the accelerating forces are of the same order as the difference in the break-away forces of the valves.

As hereinbefore set forth, the water is injected into the engine cylinder through, for example, a single orifice which is aimed at a target or anvil 52 (FIG. 1) which is located one orifice diameter from the nozzle and of the same diameter as the orifice. The jet of water hitting the target spreads out from the target in a pancake-like thin disc. At high velocity, the leading edges of the disc break up into a fine mist with 40 microns being the average particle size.

The droplets would be supersaturated water as would be expected in a pressure drop from $C_1$ to $D_1$ (FIG. 3) in the steam dome and approximately 30% of each droplet would flash into saturated steam. The loss of volume would reduce the remaining water particle size. The reduced particle size facilitates evaporation of the remaining water and, during injection from $C_2$ toward $D_2$, approximately 60% of the water would flash to steam.

To accomplish uniform distribution of water and steam to tubes 58 in the least volume, the chamber 60 should be as thin as possible (on the order of 1/64 inch) from top to bottom and the diameter should be about equal to the tube bundle diameter.

The activating mechanism of injector 48 may be one of the following:

1. A variable volume fixed stroke pump — such as a non-rusting diesel fuel injection pump short coupled to the injector;
2. A variable volume variable stroke pump; or,
3. The valve (pintle type) can be opened and closed with solenoids which are signaled from the engine shaft with means whereby the opening signal can be advanced or retarded in relation to TDC and the close signal can be varied with relation to the opening signal.

A typical cycle of operation of the engine of FIG. 1 with reference to FIG. 3 would be as follows:

Starting with saturated water from a condenser at point $A_1$ — T = 162.24; P = 5; $h$ = 130.13. The water is pumped up to a higher level of compressed water at $B_1$ — T = 162.24; P = 1100; $h$ = 130.13. (The heat equivalent of pump work is not shown) The water is heated at constant pressure in the feedwater heater to the state of saturated water $C_1$ — T = 556.31; P = 1100; $h$ = 557.4. A selected quantity of the water is then injected into the heater tubes of the engine. It is assumed that the change of state from $C_1$ to $D_1$ occurs prior to heat addition from the heater tubes, then the events are substantially as follows: Conditions $D_1$ — T = 355.36; P = 145; $h$ = 557.4.

The water at high velocity from the injector at conditions $C_1$ enters the chamber 60 which is at some lower pressure from the compression of the residual exhaust steam from conditions $H_1$ — P = 5; T = 213.03; $h$ = 1150.8; $v$ = 78.16 cu. ft./lb. to conditions $F_5$ — T = 1400; P = 500; $h$ = 1740. The two mix to form conditions at $D_1'$.

Without the compressed steam at $F_5$ already in the engine, the water at $C_1$ would have become supersaturated water upon injection, which means that water has more heat content than required for equilibrium with the pressure. The excess heat flashes part of the water to steam to form a mixture of water and steam at $D_1$; however, the mixing in of the superheated steam from $F_5$ already in the engine would form a real condition at $D_1'$; however, since the heat in the combustion gas would be inflowing through the walls of tube 58 all the while, conditions as at $D_1''$ would exist.

Since the piston would substantially be still at TDC, the water at $D_1''$ would begin to boil and to evaporate along the constant volume line to $E_1$; hence, from the saturated vapor line, all of the water would be evaporated. The vapor would superheat at constant volume to $F_1$ or $F_4$, depending on the time and heat available.

Assuming $F_4$ — T = 1600°; P = 2000; $h$ = 1840; is reached as the piston starts down on its power stroke, the steam would expand along constant enthalpy line $F_4$ — $G_1$. The expansion line shown is adiabatic. The steam expands to $G_1$ — T = 213.03; P = 15; $h$ = 1150.8; $v$ = 26.29 cu.ft./lb., at which state the exhaust valve is opened to allow steam to flow to the condenser at conditions $H_1$ — T = 213.03; P = 5; $h$ = 1150.8; $v$ = 78.16 cu.ft./lb.. The pressure drop shown as the vertical line $G_1$ — $H_1$ is required to move exhaust steam out of the cylinder to the condenser.

The amount of steam removed from the cylinder is a function of the pressure difference between $G_1$ and $H_1$. From an engine or cycle efficiency, it is desirable to have the condenser operate at a pressure as low as possible, well below atmosphere, if the cooling capacity is available. But if process heat, i.e., crop drying or space heating, is to be taken from the condenser, then the condenser temperature could be 212° F, 300° F, or higher, in which cases the engine performance would be compromised for the overall heat utilization.

In the case just discussed, about ⅓ of the steam stays in the cylinder at $H_1$. (See specific volume for points $G_1$ and $H_1$). On the upstroke this residual steam is compressed in the superheat region along $H_1$ — $F_5$ to condition $F_5$. The work of compression in this instance amounts to about ⅓ of the gross positive work. This would reduce the net power of the engine. To reduce the recompression work, the condenser can be cooled to a lower $H_1$ temperature and the steam can be mechanically removed by the piston upstroke through valve 98, FIG. 2.

For high speed engines in which the piston passes through the top arc (the 40° in which the piston is substantially still) so fast that there would not be sufficient time to evaporate the water and to then superheat it, more heat could be imparted to the water in heater 44 to a state in the super critical region as represented by $C_3$. Upon injection from $C_3$ to $E_1$ all of the super critical fluid (steam) would expand into superheated steam at $E_1$, then would be further superheated along the constant volume line $E_1$ to $F_1$ or $F_4$. Thus, a higher portion of heat would be imparted at constant pressure where time is not an urgent factor and a smaller portion of heat would be imparted in the engine under constant volume where time is a critical factor.

The advantages of injecting from $C_3$ are:

The super critical fluid is dense (almost as dense as water). The same small orifice — low inertia — fast operating valve can be used. The higher efficiency of constant volume heat input can be employed, i.e., from $E_1$ to $F_4$. The temperature and pressure conditions at $C_3$ are mild — T about 800, P about 3200, as compared to the conditions at $F_4$ at which steam would have to be admitted in a Rankine engine. The severe temperature of 1800° F at $F_4$ is more than present material of construction can tolerate under the other working conditions of pressure plus the forces and pounding of closing.

Once the working fluid has passed through the injector and is enclosed in the constant volume, the temperature and pressure can be carried to even higher state points than the conditions shown for point $F_4$. Temperature to 2000° F at pressures of 4000 psi can be considered because of the small volume of the superheater.

From the foregoing example, it is seen that the present invention fully accomplishes the disclosed aims and objects and it will be recognized by those skilled in the art that modificatios and changes may be made in the physical components comprising the engine without departing from the scope of the appended claims.

For example, the source of heat to the tubes need not be from the combustor 62 or 62' as the source can be from any source such as the exhaust gases from another form of engine such as a turbine or a Diesel or a source of industrial waste gases.

Further expansion in the engine can also be carried out entirely within the region of mixtures as shown from $F_6$ to $G_3$, FIG. 3, and then to exhaust.

Still further, while the working fluid of the examples is water-steam, most any condensable fluid may be employed such as alcohol, ammonia, Freon 50 or 85, fluorenol, etc.

We claim:

1. A method of operating an external combustion reciprocating piston engine using a condensable vapor as a working fluid and having a cylinder with a piston operating therein characterized in that the heat input communicates with the clearance volume of the cylinder and all of the working fluid mechanically and thermodynamically possible, is removed from the cylinder adjacent and/or following bottom dead center of the piston; wherein the working fluid comprises steam and the water is injected into the clearance volume of the cylinder; and the water is in the region of superheat in respect to temperature at the time of injection.

2. The invention as defined in claim 1 wherein the compressed working fluid is heated by the exhaust cylinder heating gases.

3. The invention defined in claim 2 wherein a portion of the exhaust heat from the external combustion is employed to heat the combustion air.

4. A method of operating an external combustion reciprocating piston engine using a condensable vapor as a working fluid and having a cylinder with a piston operating therein characterized in that the heat input communicates with the clearance volume of the cylinder and all of the working fluid, mechanically and thermodynamically possible, is removed from the cylinder adjacent and/or following bottom dead center of the piston, and evaporation and superheating of the working fluid takes place in the clearance volume of the engine at constant volume.

5. The invention defined in claim 4 in which the working fluid is injected into the clearance volume of the engine in its liquid state at a temperature and pressure less than the temperature and pressure reached within the clearance volume prior to expansion of the vapor on the downstroke of the engine.

6. The invention as defined in claim 5 in which the working fluid is water and is heated outside of the engine at constant pressure and in which the fluid is injected into the engine as saturated water wherein the water flashes to a mixture of steam and water at a lower pressure and temperature than at which it was injected and which water of the mixture is evaporated after which the steam is superheated at constant volume and is then expanded in the cylinder.

7. The invention as defined in claim 6 in which heated water is injected into the engine after which the water is evaporated in the engine, further wherein the vapor is superheated within the engine, then expanded within the engine and exhausted therefrom at a lower pressure.

8. The invention as defined in claim 7 in which high density fluid is injected into the engine.

9. The invention defined in claim 8 wherein additional heat is imparted in the clearance volume under constant volume conditions to the injected high density fluid.

10. An energy converting cycle in which heat is converted to mechanical power by the series of thermal functions employing a condensable working fluid comprising:

(a) compressing working fluid in its liquid form from the cycle low pressure point to a higher pressure level at constant enthalpy;

(b) heating the working fluid liquid at constant pressure to its saturated liquid state;

(c) injecting saturated liquid working fluid into the clearance volume of an expander;

(d) expanding at constant enthalpy within the clearance volume of the expander the injected saturated liquid working fluid which then evolves a mixture of vapor and liquid at the new lower equilibrium pressure and temperature at equal total heat;

(e) heating at constant volume the working fluid mixture at conditions within the region of mixtures until it is evaporated to the dry saturated vapor state;

(f) heating the dry saturated vapor at constant volume until the desired pressure and temperature state is reached;

(g) expanding the superheated vapor adiabatically in the expander wherein the conversion of heat to mechanical energy occurs;

(h) removing the expanded vapor from the expander by further expansion at constant enthalpy, and/or by mechanically being transferred without a pressure drop; and, (i) condensing the removed expander vapor at constant pressure.

11. An energy converting cycle as defined in claim 10 in which the working fluid in its liquid state is raised from the low pressure to a high pressure with increasing enthalpy.

12. An energy converting cycle as defined in claim 11 in which the working fluid is heated at constant pressure from its liquid state to a superheated supercritical state.

13. An energy converting cycle as defined in claim 10 in which the injected supercritical superheated steam expands to a superheated state at a lower temperature and pressure at constant enthalpy from which state it receives heat at constant volume until the desired temperature and pressure is reached from which it is expanded in a device which produces mechanical power.

14. An invention like claim 10 in which the high energy vapor is expanded under conditions that heat is continuously added to a portion of the expanding fluid.

* * * * *